US007597242B2

(12) United States Patent
Covelli

(10) Patent No.: US 7,597,242 B2
(45) Date of Patent: Oct. 6, 2009

(54) OVENABLE SHIPPING AND SERVING CONTAINER

(75) Inventor: Jeffrey S. Covelli, Delafield, WI (US)

(73) Assignee: Innovative Fiber, LLC, Hartland, WI (US)

( * ) Notice: Subject to any disclaimer, the term of this patent is extended or adjusted under 35 U.S.C. 154(b) by 633 days.

(21) Appl. No.: 11/360,943

(22) Filed: Feb. 23, 2006

(65) Prior Publication Data

US 2006/0186185 A1 Aug. 24, 2006

Related U.S. Application Data

(60) Provisional application No. 60/655,399, filed on Feb. 23, 2005.

(51) Int. Cl.
*B65D 5/00* (2006.01)
*B65D 5/28* (2006.01)
*B65D 17/00* (2006.01)

(52) U.S. Cl. ..... 229/122; 229/171; 229/182; 229/190; 229/243

(58) Field of Classification Search ..... 229/122, 229/190, 243, 903, 171, 149, 182, 906; 426/113, 426/115, 122
See application file for complete search history.

(56) References Cited

U.S. PATENT DOCUMENTS 3,863,832 A 2/1975 Gordon et al.
4,403,729 A * 9/1983 Wytko ..... 229/149
4,418,119 A 11/1983 Morrow et al.
4,543,280 A 9/1985 Fujita et al.
4,573,633 A * 3/1986 Brian ..... 229/167
4,746,019 A 5/1988 Prater
4,900,594 A 2/1990 Quick et al.
5,002,833 A 3/1991 Kinsey, Jr. et al.
5,103,999 A * 4/1992 Elliott et al. ..... 220/570
5,121,876 A * 6/1992 Johnson ..... 229/117.07
5,498,452 A 3/1996 Powers
5,660,898 A 8/1997 Calvert
6,186,931 B1 * 2/2001 Calvert et al. ..... 493/8
6,307,192 B1 10/2001 Ulfstedt et al.
6,866,189 B2 * 3/2005 Nelson ..... 229/242

* cited by examiner

*Primary Examiner*—Gary E Elkins
*Assistant Examiner*—Latrice Byrd
(74) *Attorney, Agent, or Firm*—Boyle Fredrickson, S.C.

(57) ABSTRACT

The present invention is a container for use in baking and shipping food items. The container is formed of a paperboard material and includes a heat-resistant coating applied to all of the interior surfaces of the container. The coating enables a number of food items to be positioned within the container in contact with the coating such that the container and food items can be baked to properly prepare the food items therein. After baking, the container and food items can then be wrapped or otherwise packaged for shipment without transferring the food items to a separate shipping container. The container also includes a pair of end walls that are movable with respect to the container between retaining and dispensing positions to enable the container to be configured as serving tray for the items contained therein.

5 Claims, 5 Drawing Sheets

FIG. 3
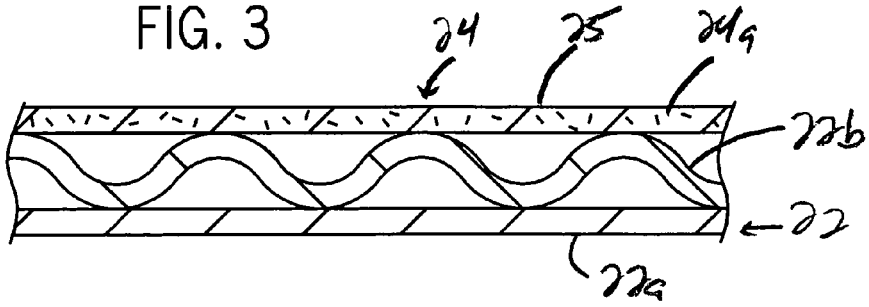
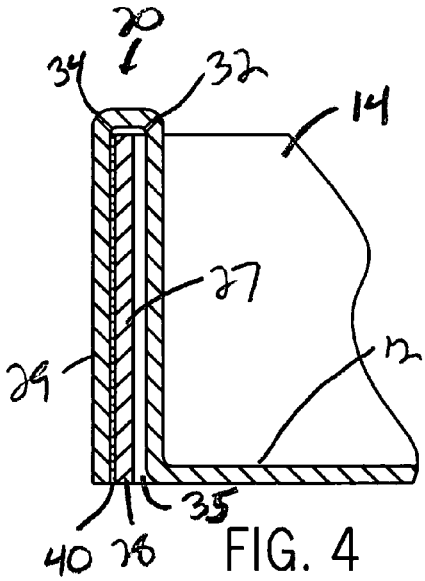
FIG. 4
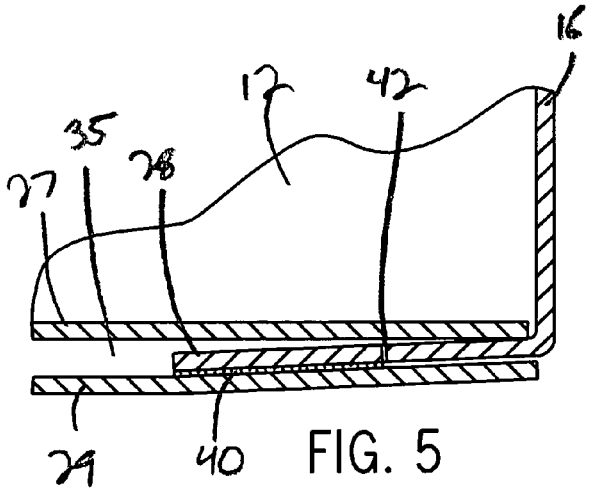
FIG. 5
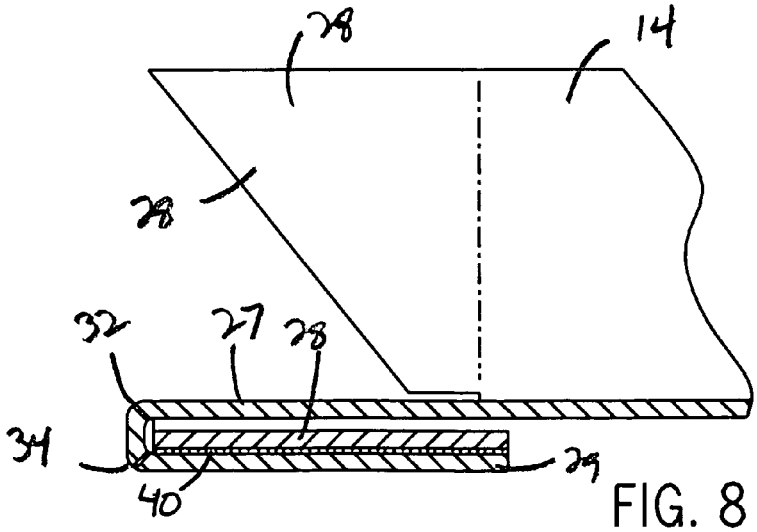
FIG. 8

OVENABLE SHIPPING AND SERVING CONTAINER

CROSS-REFERENCE TO RELATED APPLICATION

This application claims priority from U.S. Provisional Patent Application Ser. No. 60/655,399, filed on Feb. 23, 2005, the entirety of which is incorporated herein by reference.

FIELD OF THE INVENTION

The present invention relates to shipping containers, and more specifically to a container for use in preparing, shipping and serving a food item.

BACKGROUND OF THE INVENTION

In order to prepare and ship food items, such as baked goods, initially the food items must be properly prepared and then placed into proper shipping containers. For baked goods, this process normally involves the steps of forming and/or preparing, and baking the food items on a metal tray capable of withstanding the temperatures at which the food items are baked. After the items have been baked for an appropriate amount of time, the items are transferred from the metal tray to a separate shipping container, normally formed from a suitable material, such as a linerboard or corrugated medium. The food items thus positioned in the container are then wrapped or otherwise enclosed within the container to prepare the items for shipment.

With regard to the step of transferring the baked goods from the metal tray to the container, this step requires that the food items and tray be allowed to cool sufficiently to enable the items to be moved from the tray to the container for a number of reasons. The amount of time required for the items to cool greatly increases the amount of time required for the packaging of the food items. Thus, it is desirable to omit the step of transferring the baked food items from the metal trays to the corrugated shipping containers due to the time and expense required.

Furthermore, once the goods have been packaged and shipped to the ultimate consumer, it is difficult to remove the food items from within the container. Often times the container must be broken apart in order to enable the food items to be easily removed from the container.

Therefore, it is desirable to develop a container capable of holding the food items both during preparation or baking, and during shipment and that allows for the easy removal of the items from the container.

SUMMARY OF THE INVENTION

According to one aspect of the present invention, a container or tray is provided which is formed of a suitable material, such as a corrugated medium, includes an ovenable layer disposed on the entire interior surface of the container. The ovenable layer is provided by a suitable heat-resistant coating applied over the interior surface of the container such that all surfaces on the interior of the container that may come into contact with the food items during the baking of the food items are covered with the ovenable coating. Further, the container is formed such that the shape of the container allows the container and the food items held within the container to be easily packaged for shipment after the preparation or baking of the food items within the container.

According to another aspect of the present invention, the container is formed from a blank of a suitable corrugated material that has the suitable heat-resistant coating applied to one side or surface of the material. The blank is then formed into the container by folding the various portions of the blank and securing these portions to one another, such as by utilizing a suitable adhesive capable of withstanding the temperatures at which the food items held within the container are prepared. The construction of the blank and the resulting container forms an easy open structure at one or both ends of the container that allows the container to be broken down or opened at each end, such that the container can be reconfigured and utilized to serve the food items when the food items are to be removed from the container.

Numerous other aspects, features and advantages of the present invention will made apparent from the following detailed description taken together with the drawing figures.

BRIEF DESCRIPTION OF THE DRAWINGS

The drawings illustrate the best mode currently contemplated of practicing the present invention.

In the drawings:

FIG. 3 is a cross-section view along line 3-3 of FIG. 2;

FIG. 4 is a cross-sectional view along line 4-4 of FIG. 1;

FIG. 5 is a cross-sectional view along line 5-5 of FIG. 1;

FIG. 8 is a cross-sectional view along line 8-8 of FIG. 7; and

DETAILED DESCRIPTION OF THE PRESENT INVENTION

Figure 1:
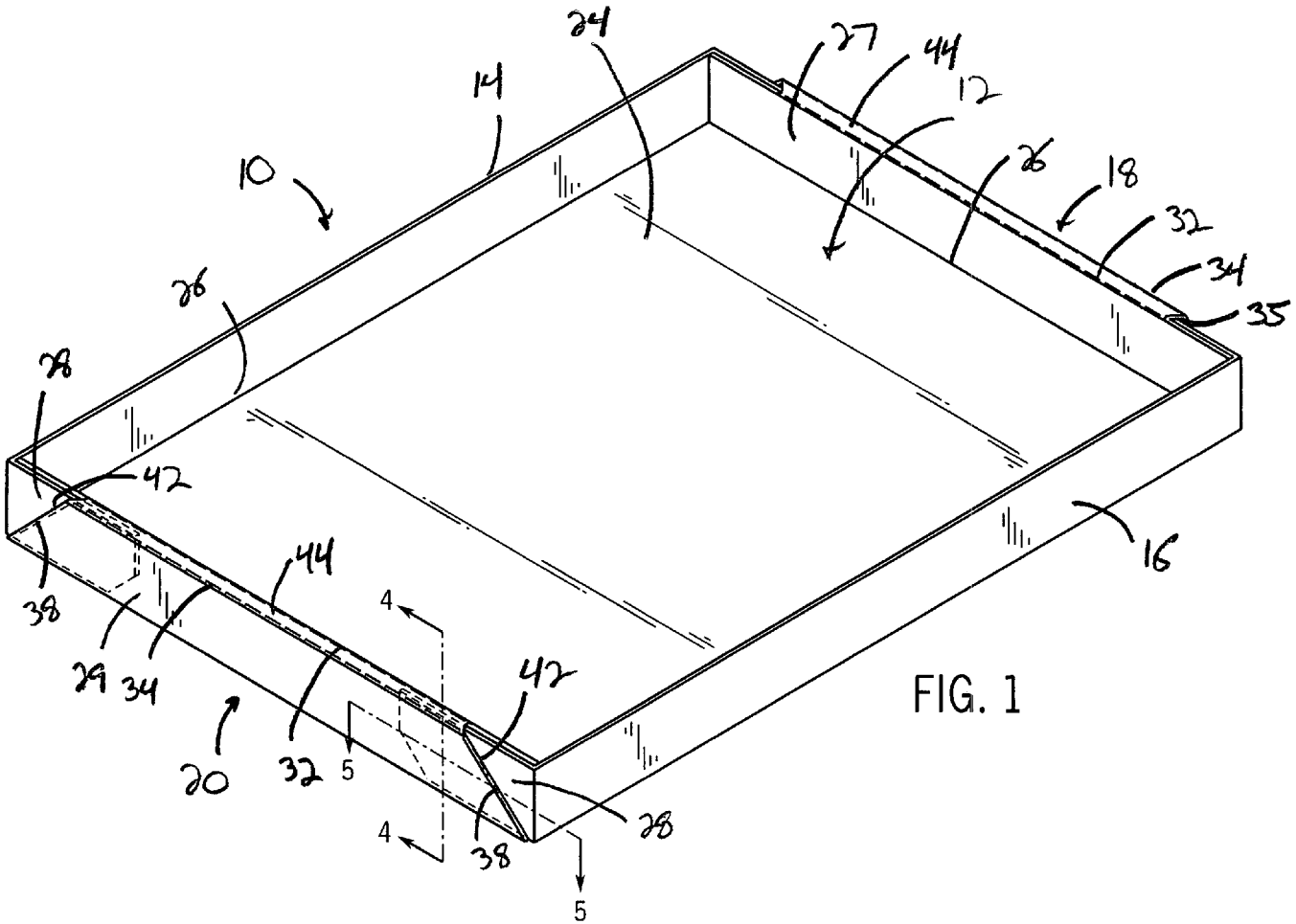
FIG. 1 is a perspective view of a container constructed according to the present invention.

With reference now to the drawing figures in which like reference numerals designate like parts throughout the disclosure, a container formed according to the present invention is illustrated generally at 10 in FIG. 1. The container 10 includes a bottom wall 12, a pair of opposed sidewalls 14 and 16, and a pair of opposed end walls 18 and 20, each connected to the bottom wall 12. Each of the bottom wall 12, side walls 14 and 16, and end walls 18 and 20 have an outer layer 22, which is preferably formed of a suitable material, such as a linerboard medium, among others, and which forms the exterior of the container 10, and an inner layer 24, also formed of a suitable material, such as one or both of a linerboard medium. The particular material chosen for the layers 22 and 24 can be selected based on the strength and rigidity required for the container 10 to hold the particular food items 100 to be contained therein. An ovenable coating 25 is applied over the layer 24 which forms the exposed surface of each of the bottom wall 12, side walls 14 and 16, and end walls 18 and 20 on the interior of the container 10. The ovenable coating 25 on layer 24 can be applied as a separate material layer for the container 10, or preferably can be applied, e.g., sprayed onto or impregnated within, among other suitable application methods, to the inner material layer 24 for the container 10. In a particularly preferred embodiment shown in FIG. 3, the container 10 includes a lower linerboard layer 22*a*, and central corrugated medium 22*b*, and an upper linerboard layer 24*a*, to which the coating 25 is applied. Also, each of the side walls 14 and 16 and end walls 18 and 20 is joined to the bottom wall 12 along a fold line 26, such that the ends of the respective walls 14-20 can be positioned adjacent one another to define and enclose the interior of the container 10.

In a preferred embodiment, as best shown in FIGS. 1-5 and 7-9, each of the end walls 18 and 20 are formed with an inner portion 27 positioned immediately adjacent the fold line 26, and an outer portion 29 extending from inner portion 27 away from the fold line 26. Both the inner portion 27 and outer portion 29 can be covered with 18 and 20 may also be formed such that the outer portion 29 does not include the coating 24. To form the end walls 18 and 20, initially the end walls 16 and 20 have the inner portion 27 pivoted with regard to the fold line 26, such that the outer portion 29 and inner portion 27 are positioned generally perpendicular with regard to the bottom wall 12. The outer portion 29 is then folded with respect to the inner portion 27 along a pair of fold lines 32 and 34 disposed between the inner portion 27 and outer portion 29. The spacing of the fold lines 32 and 34 allows the outer portion to be spaced from the inner portion 27 a distance defined by the distance between the fold lines 32 and 34 such that a channel 35 is defined between the outer portion 29 and the inner portion 27. The channel 35 allows the outer portion 29 to be easily grasped and pulled away from the inner portion 27 to open the end walls 18 and 20 in a manner to be described. In addition, each outer portion is formed with tapered side edges 38 to facilitate the opening of the end walls 18 and 20 in the manner to be described.

The side walls 14 and 16 are also formed by pivoting the side walls 14 and 16 into a generally perpendicular position with regard to the bottom wall 12. To hold the side walls 14 and 16 in this perpendicular position, the side walls 14 and 16 are each connected to each of the end walls 18 and 20 by folding tabs 28 disposed on each end of the side walls 14 and 16 and separated from the side walls 14 and 16 by fold lines 30. The tabs 28 can be folded inwardly towards each of the adjacent end walls 18 and 20. The tabs 28 are formed to have a shape that is easily positionable within the recess 35 defined between the inner portion 27 and outer portion 29 of each end wall 18 and 20, such that the positioning of the tabs 28 within the recesses 35 selectively engages the side walls 14 and 16 with the end walls 18 and 20. In this configuration, the tabs 28 can then be secured to the end walls 18 and 20 in any suitable manner, such as by using an adhesive 40, and preferably a cold set adhesive which will not degrade when subjected to the temperatures at which the food items held within the container 10 are prepared. The adhesive 40 is applied only between the outwardly facing surface of the tabs 28 and the inwardly facing surface of the outer portion 29 that covers the tabs 28, as best shown in FIGS. 4 and 5. This placement of the adhesive 40 provides sufficient strength to keep the end walls 18 and 20, and specifically the outer portions 29, secured to the tabs 28, and thereby to maintain the container 10 in the closed configuration. Further the lack of any adhesive 40 between the tabs 28 and the inner portion 27 allows the tabs 28 to be partially separated from the container 10 to move the end walls 18 and 20 into a dispensing configuration, as will be described.

Figures 7, 9:
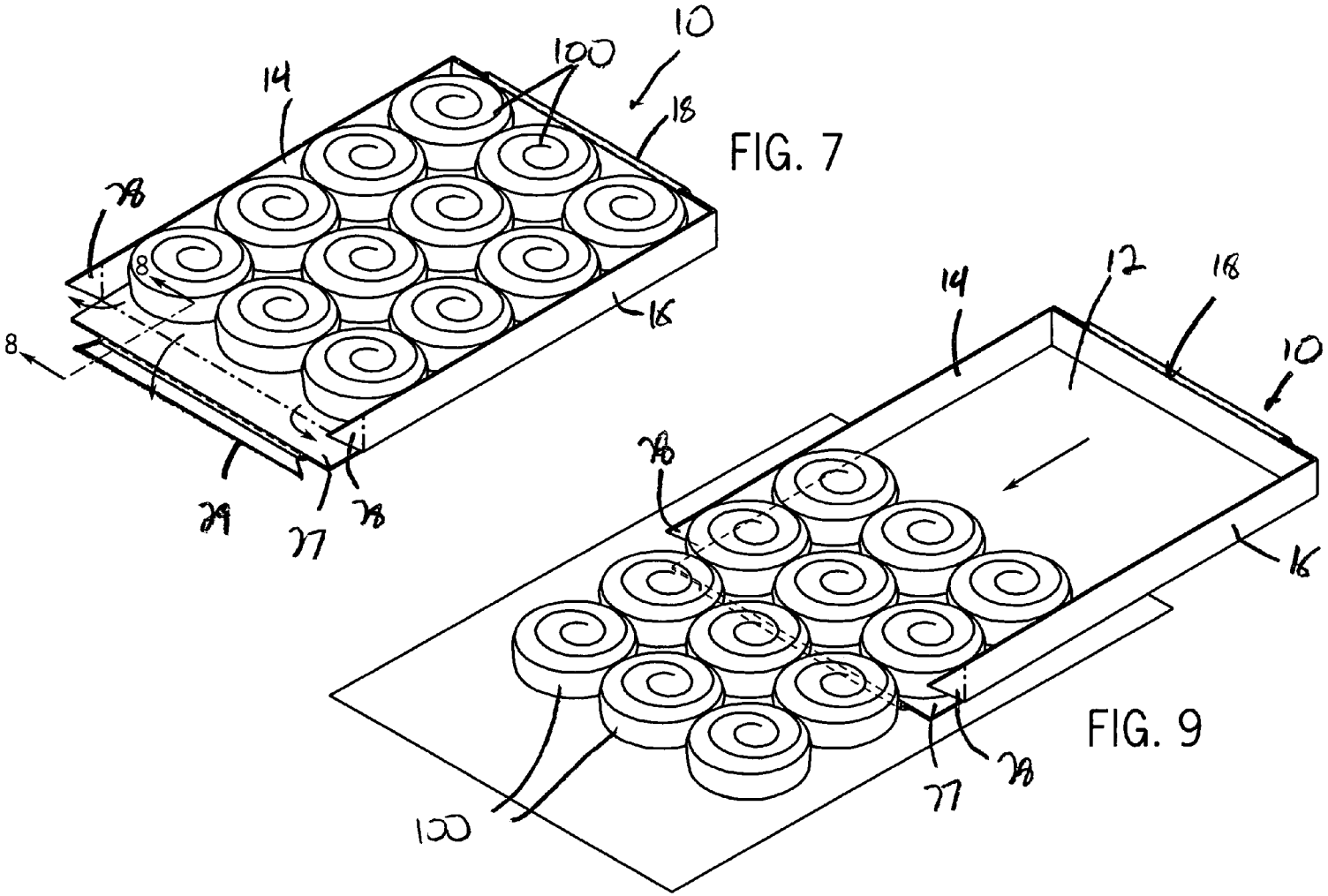
FIG. 7 is an isometric view of the container of FIG. 1 in a dispensing configuration with one of the end walls of the container in an opened position.
FIG. 9 is an isometric view of the container of FIG. 7 with the food items being removed from the container.

In addition, each of the tabs 28 includes a line of weakness 42, e.g., a perforated line, knife cut, score line, or the like, formed therein. The line 42 is formed on each tab 28 in a direction that places the line 42 in alignment with the adjacent edge 38 of the outer portion 29 when the tab 28 is secured to the outer portion 29 by the adhesive 40. The positioning of the line 42 in alignment with the edges 38 of the outer portion 29 enables the edges 38 to provide additional strength to the tabs 28 along the line 42, keeping the end walls 18 and 20 in the closed position and preventing the line 42 from separating different portions of the tabs 28 from one another until desired. However, when a sufficient force is applied to the outer portion 29 in a direction pulling the outer portion 29 away from the bottom wall 12, the edges 38 of the outer portion 29 press against the lines 42 causing the tabs 28 to separate along the lines 42. The tabs 28 separate along the line 42 with the part of the tab 28 to which the adhesive 40 was applied attached to the outer portion 29, and the remaining part of the tabs 28 staying attached to the side walls 14 and 16, as best shown in FIGS. 7-9. The end walls 18 and 20 can then be pivoted away from the bottom wall 12 to open that end of the container 10 for easy access to and dispensing of the food items 100 held therein.

Figure 2:
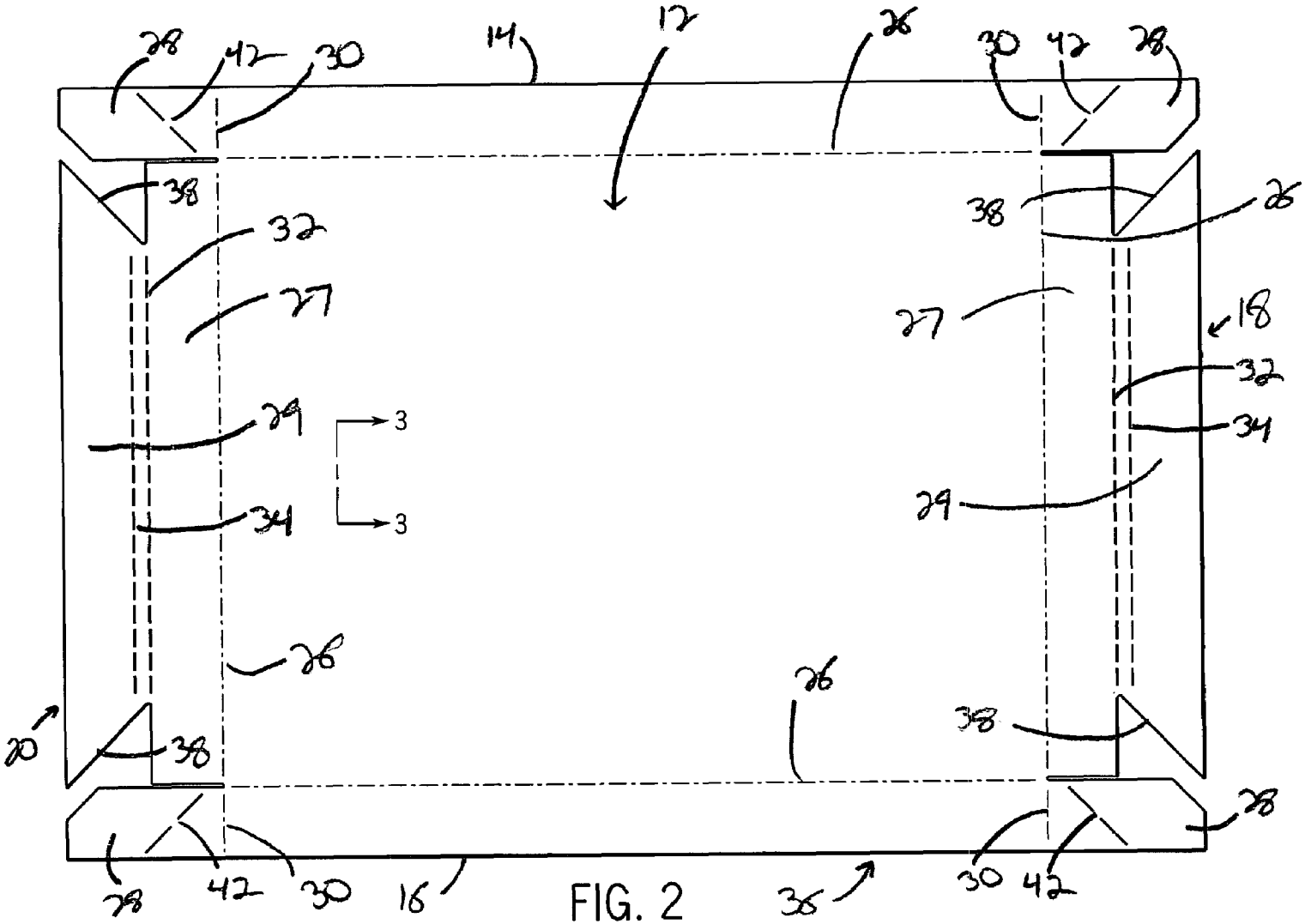
FIG. 2 is a top plan view of a blank utilized to form the container of FIG. 1.

Referring now to FIG. 2, a blank 36 utilized to form the preferred embodiment of the container 10 is illustrated. The blank 36 is formed of the suitable material layer 22*a*, 22*b* and 24, with the ovenable coating 25 positioned completely over one side of the material layer 24. The ovenable coating 25 can be formed from any suitable material capable of protecting the material layer 24 and withstanding the heat at which the food items 100 are baked. Suitable materials for use in forming the ovenable coating 25 include polymethyl pentane or Michelman 50A, among others. In order to form the blank 36, the layers 22*a*, 22*b* and 24 are initially formed into the blank 36 having the desired shape for the container 10, and, as shown in the drawing figures, preferably a generally rectangular shape. A number of notches 50 are then formed at each corner of the blank 36 in order to define the various portions of the end walls 18 and 20 and the tabs 28. Cuts 52 are further made along the ends of the end walls 18 and 20 to separate the tabs 28 from the end walls 18 and 20. The lines 42 can then be formed in each of the tabs 28 for enabling the opening of each end wall 18 and 20, and the fold lines 26, 32 and 34 can be formed between the walls 14-20 and bottom wall 12 and between the inner portion 27 and outer portion 29 of each end walls 18 and 20. In forming the fold lines 26, the fold lines 26 are formed in a manner which enables the layer 24 to maintain a continuous surface between the bottom wall 12 and each side wall 14 and 16 and end wall 18 and 20 across the fold lines 26 when the container 10 is formed, such that the ovenable coating 25 can be continuous across the entire interior surface of the container 10. However, the fold lines 32 and 34 and lines 42 can be formed in a perforated manner, as they will not come into contact with the food items 100 held in the container, such that the coating 25 is interrupted by the perforations forming the fold lines 32 and 34, and lines 42.

Figure 6:
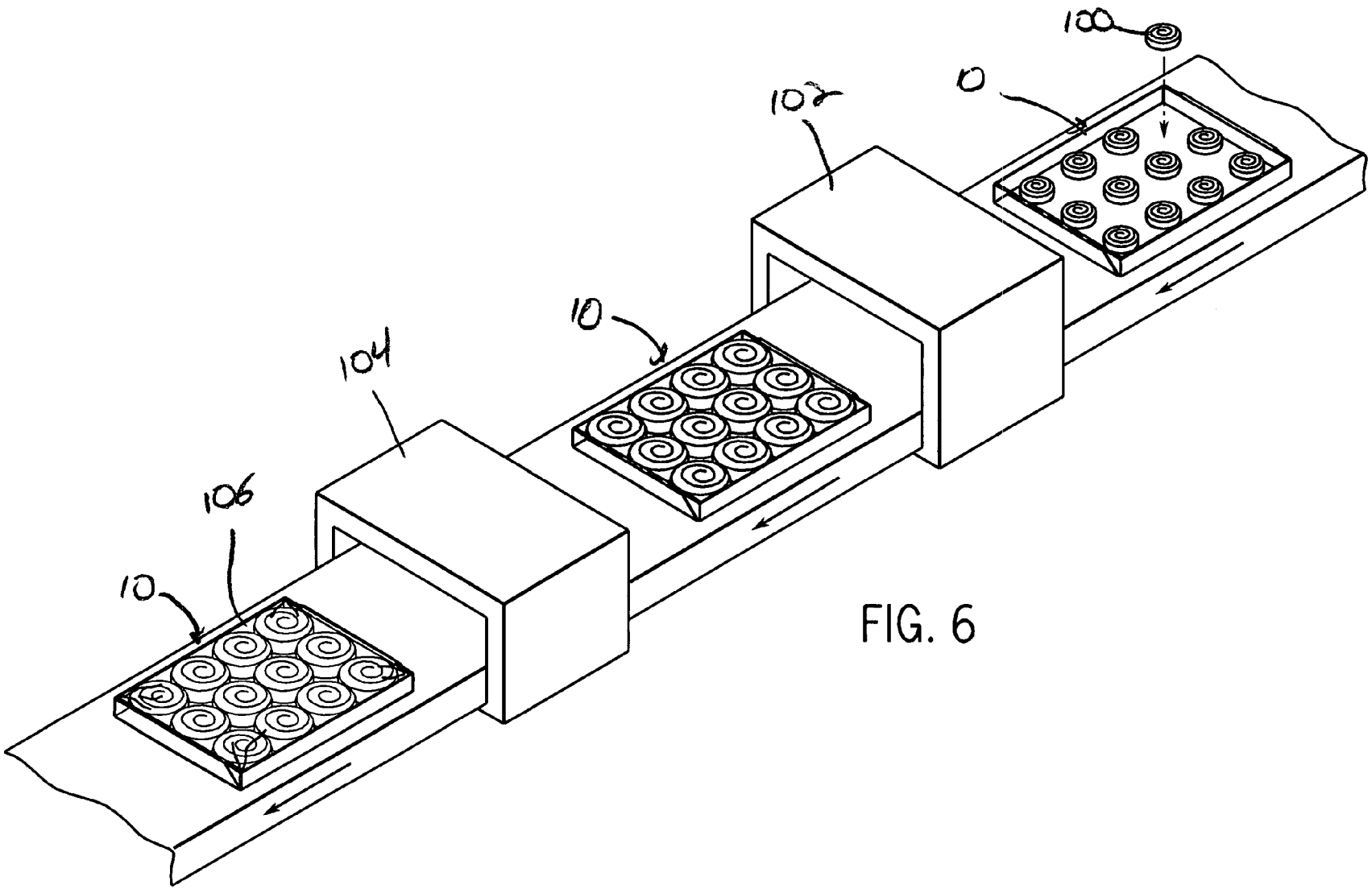
FIG. 6 is a perspective view of a process for preparing and packaging food items using the container of FIG. 1.

Looking now at FIG. 6, after the container 10 has been formed, the various food items 100 can be positioned within the container 10 such that the container 10 and the food items 100 held therein can be run through or placed within an oven 102 for baking of the food items 100. After the food items 100 have been sufficiently prepared, the container 10 and food items 100 are removed from the oven 102, allowed to cool sufficiently, and subsequently packaged for shipment. The particular method or apparatus for packaging the food items 100 in the container 10 can be selected from any suitable method, but is preferably a shrink-wrapping mechanism 104 in which a film 106 is positioned around and heat shrunk into conformance with the shape of the container 10 and the food items 100 to enable the container 10 to retain the food items 100 therein during shipment.

Various alternatives are contemplated as being within the scope of the following claims particularly pointing out and distinctly claiming the subject matter regarded as the invention.

The invention claimed is:

1. A container for preparing, shipping and serving food items, the container comprising:

a) a bottom wall;

b) a pair of opposed side walls each joined to the bottom wall at one end;

c) a pair of opposed end walls extending between the pair of opposed side walls, each end wall joined to the bottom wall at one end and movable between a retaining position and a dispensing position wherein each of the pair of end walls comprises an inner portion secured to the bottom wall and an outer portion having a pair of opposed edges and connected to the inner portion opposite the bottom wall and defining a channel between the inner portion and the outer portion; and d) a heat-resistant material present on an interior surface of each of the bottom wall, the side walls and the end walls, wherein each of the pair of side walls includes a pair of opposed tabs at each end engageable within the channel defined in each end wall, wherein each tab includes a line of weakness extending across each tab, defining a first part disposed between the side wall and the line of weakness, and a second part disposed between the line of weakness and the end of the tab, and wherein the line of weakness extends across each tab in alignment with the opposed edges of the outer portion of each of the pair of end walls.

2. The container of claim 1 wherein the line of weakness extends diagonally across each tab.

3. The container of claim 1 further comprising an adhesive applied between the outer portion of each end wall and the second part of the tab.

4. The container of claim 1 wherein the inner portion and the outer portion of each of the pair of end walls are pivotably joined by a strip disposed between the inner portion and the outer portion and a pair of perforated lines disposed on either side of the strip.

5. A container for preparing, shipping and serving food items, the container comprising:

a) a bottom wall;

b) a pair of opposed side walls each joined to the bottom wall at one end;

c) a pair of opposed end walls extending between the pair of opposed side walls, each end wall joined to the bottom wall at one end and movable between a retaining position and a dispensing position wherein each of the pair of end walls comprises an inner portion secured to the bottom wall and an outer portion having a pair of opposed edges and connected to the inner portion opposite the bottom wall and defining a channel between the inner portion and the outer portion; and d) a heat-resistant material present on an interior surface of each of the bottom wall, the side walls and the end walls, wherein each of the pair of side walls includes a pair of opposed tabs at each end engageable within the channel defined in each end wall, wherein each tab includes a separable line of perforations extending across each tab, wherein the line of perforations extends across each tab in alignment with the opposed edges of the outer portion of each of the pair of end walls such that the opposed edges provide additional strength to the tabs along the line of perforations to maintain the end walls in the closed position and prevent the line of perforations from separating different portions of the tabs from one another until a sufficient force is applied to the tabs.

* * * * *